US008403616B2

(12) United States Patent
Kurdlya

(10) Patent No.: US 8,403,616 B2
(45) Date of Patent: Mar. 26, 2013

(54) MOVABLE DEBRIS APPARATUS FOR RECEIVING AND COLLECTING DEBRIS

(76) Inventor: Paul Kurdlya, Carteret, NJ (US)

( * ) Notice: Subject to any disclaimer, the term of this patent is extended or adjusted under 35 U.S.C. 154(b) by 69 days.

(21) Appl. No.: 12/804,037

(22) Filed: Jul. 13, 2010

(65) Prior Publication Data

US 2012/0014771 A1 Jan. 19, 2012

(51) Int. Cl.
*B65F 3/00* (2006.01)

(52) U.S. Cl. ..... 414/551; 414/406

(58) Field of Classification Search ..... 414/11, 414/12, 22.65, 332, 340, 343, 345, 346, 349, 414/350, 403, 404, 406, 419, 420, 421, 425, 414/467, 469, 487, 554, 697, 705, 710, 742, 414/743, 758, 759, 779, 265, 407, 408, 411, 414/414, 338, 474, 475, 486, 546, 679, 713, 414/728, 551, 473, 553; 280/79.2; 296/101, 296/37.1, 24.4; 220/562, 564; 37/304, 411, 37/403

See application file for complete search history.

(56) References Cited

U.S. PATENT DOCUMENTS

| | | | | | |
|---|---|---|---|---|---|
| 251,194 | A | * | 12/1881 | Cushing et al. | 414/469 |
| 693,475 | A | * | 2/1902 | Whittemore | 15/85 |
| 1,100,241 | A | * | 6/1914 | Hoster | 414/690 |
| 1,337,332 | A | * | 4/1920 | Sills | 414/551 |
| 1,394,230 | A | * | 10/1921 | Sills | 414/551 |
| 1,776,034 | A | * | 9/1930 | Krahn | 414/407 |
| 2,347,456 | A | * | 4/1944 | Beckwith | 414/685 |
| 2,362,994 | A | * | 11/1944 | Frost | 414/487 |
| 2,392,025 | A | * | 1/1946 | Craig | 414/549 |
| 2,544,505 | A | * | 3/1951 | Kronhaus | 414/554 |
| 2,681,739 | A | * | 6/1954 | Gokey | 414/546 |
| 2,949,199 | A | * | 8/1960 | Jones | 414/408 |
| 3,126,110 | A | * | 3/1964 | Dinkloh | 414/546 |
| 3,127,039 | A | * | 3/1964 | Christiansen | 414/420 |
| 3,137,402 | A | * | 6/1964 | Gunn, Jr. | 414/421 |
| 3,153,866 | A | * | 10/1964 | Bordeaux et al. | 37/409 |
| 3,930,643 | A | * | 1/1976 | Moore | 269/58 |
| 4,698,150 | A | * | 10/1987 | Wigoda | 209/421 |
| 4,988,257 | A | * | 1/1991 | Dahlin et al. | 414/420 |
| 5,484,245 | A | * | 1/1996 | Zopf | 414/408 |
| 5,735,663 | A | * | 4/1998 | Zachhuber | 414/338 |
| 6,019,431 | A | * | 2/2000 | Rexus et al. | 298/23 MD |

* cited by examiner

*Primary Examiner* — Saul Rodriguez
*Assistant Examiner* — Glenn Myers
(74) *Attorney, Agent, or Firm* — Ezra Sutton

(57) ABSTRACT

The present invention provides for a movable debris apparatus for receiving and collecting debris, including a collector for receiving and collecting debris in the collector mounted in the front of the debris apparatus. A waste bin is provided for receiving and holding debris collected by the collector mounted in the rear of the debris apparatus. Two sets of gears are provided for pivotally connecting the collector to the debris apparatus. An operating handle has a U-shape with two legs having teeth thereon for engaging the two sets of gears by moving the handle up and down to turn the gears and pivot the collector between a first position for receiving and collecting the debris and a second position for transferring the debris in the collector to the waste bin.

6 Claims, 7 Drawing Sheets rack moves ↕ about 8" inches

MOVABLE DEBRIS APPARATUS FOR RECEIVING AND COLLECTING DEBRIS

FIELD OF THE INVENTION

The present invention relates to a portable and movable debris apparatus for receiving and collecting debris, including a debris collector and a waste bin.

BACKGROUND OF THE INVENTION

Existing debris collectors do not have the features of the present invention, wherein the debris is first collected in a collector unit 12, which is then lifted and pivoted to transfer the debris to a waste bin 30 behind the collector 12 by a simple gear mechanism.

SUMMARY OF THE INVENTION

A movable debris apparatus for receiving and collecting debris, including a collector for receiving and collecting debris in the collector mounted in the front of the debris apparatus. A waste bin is provided for receiving and holding debris collected by the collector mounted in the rear of the debris apparatus. Two sets of gears are provided for pivotally connecting the collector to the debris apparatus. An operating handle has a U-shape with two legs having teeth thereon for engaging the two sets of gears by moving the handle up and down to turn the gears and pivot the collector between a first position for receiving and collecting the debris and a second position for transferring the debris in the collector to the waste bin.

DETAILED DESCRIPTION OF THE APPARATUS

Figure 1:
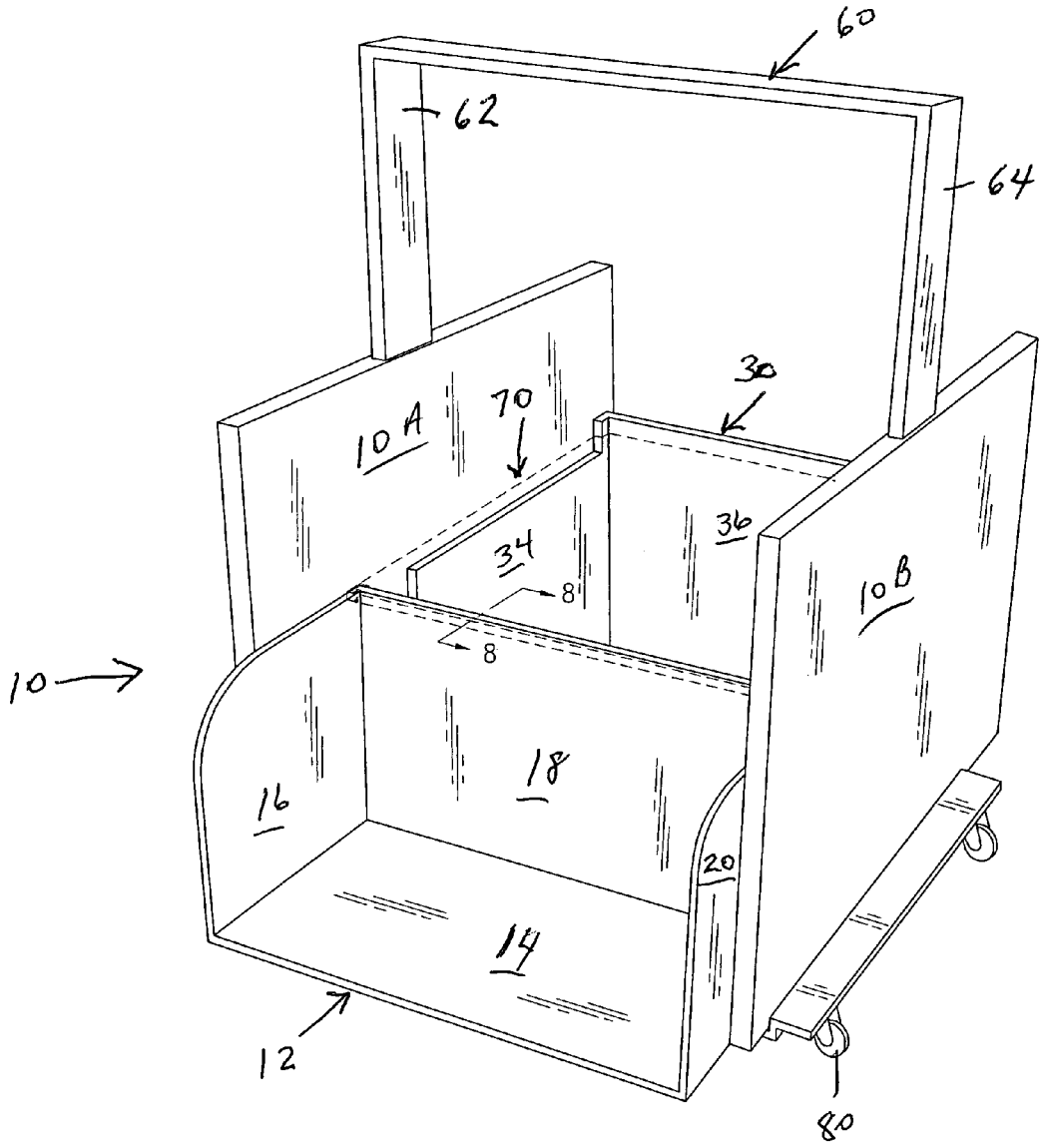
FIG. 1 shows a front perspective view of the apparatus.
Figure 2:
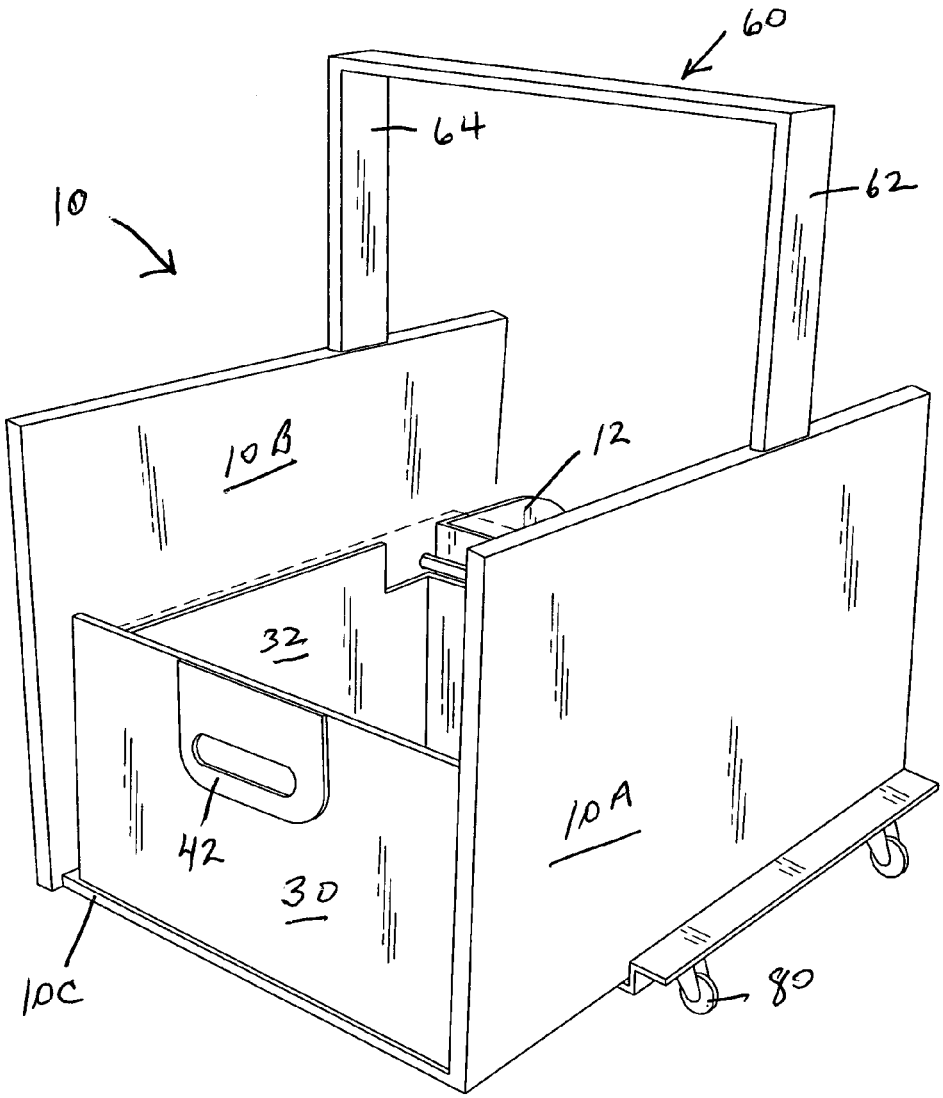
FIG. 2 shows a rear perspective view of the apparatus.
Figure 3:
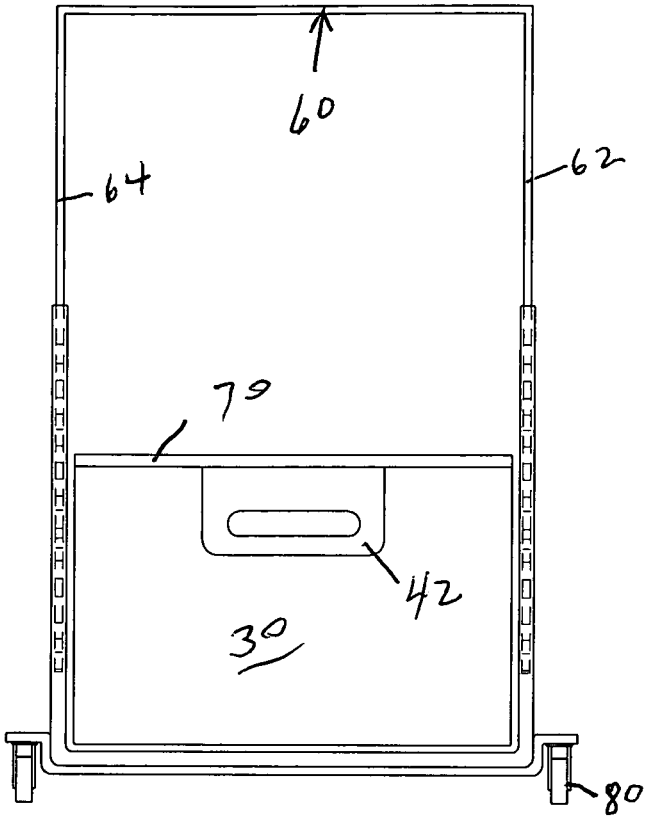
FIG. 3 shows a rear elevational view.
Figure 4:
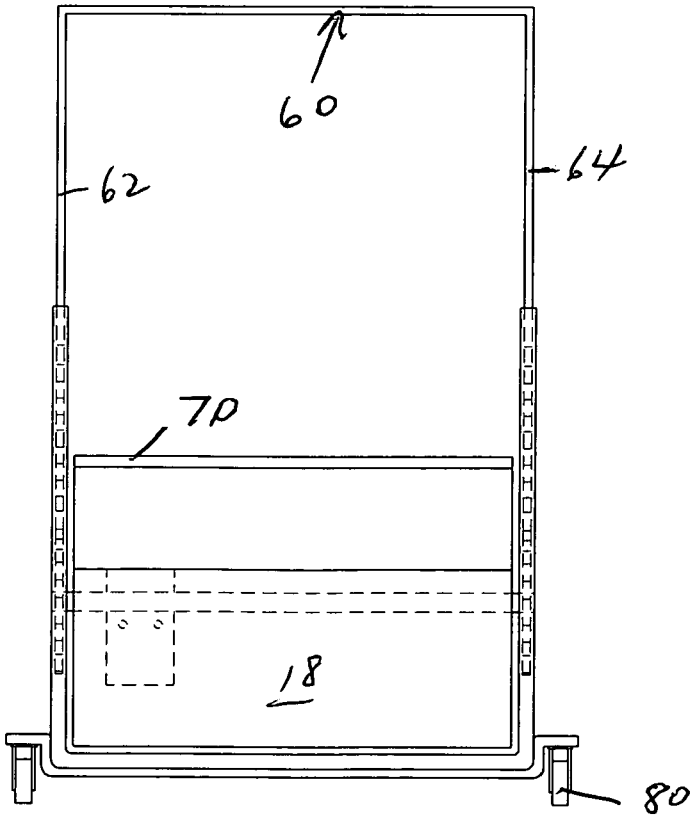
FIG. 4 shows a front elevational view.
Figure 5:
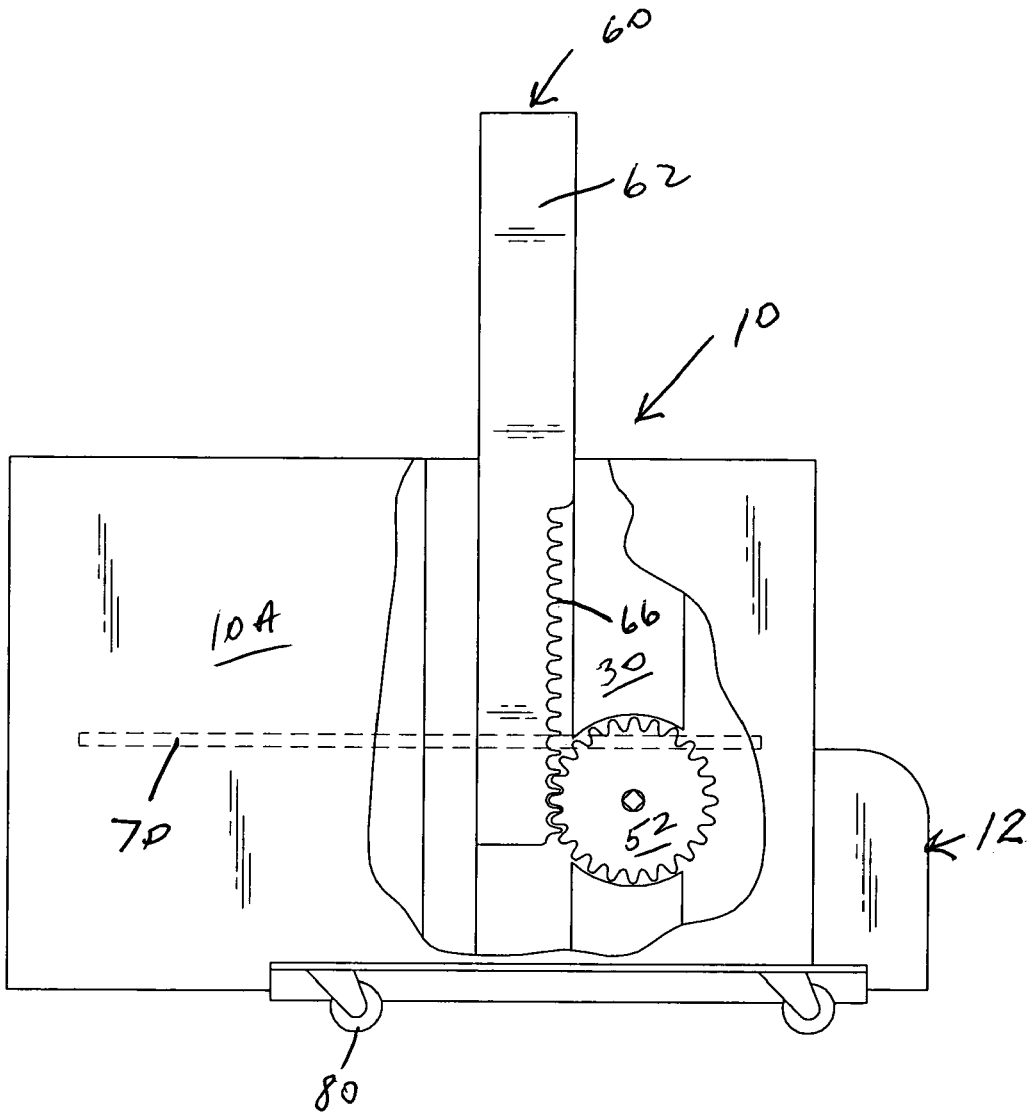
FIG. 5 shows a side elevational view.

A movable debris apparatus 10 for receiving and collecting debris is provided. The apparatus 10 includes a frame having side walls 10A, 10B and a bottom wall 10C for receiving the waste bin 30. Apparatus 10 further includes a collector 12 for receiving and collecting debris in the collector 12 mounted in the front of the debris apparatus 10. Collector 12 includes a bottom wall 14 and three side walls 16, 18, and 20 so that debris may be swept directly into collector 12 when a surface or floor is being cleaned.

A waste bin 30 is provided for receiving and holding debris collected by the collector 12 mounted in the rear of the debris apparatus 10. Waste bin 30 includes a bottom wall 32 and four side walls 34, 36, 38, and 40, to form a container for holding the debris. Waste bin 30 is slidably removable from the apparatus 10 to easily dispose of the collected debris. The waste bin 30 slides between a first position for collecting the debris and a second position for removing the waste bin 30 from collector 12 to empty the waste bin 30. A handle 42 is provided on waste bin 30 to slidably pull waste bin 30 from its first position to its second position.

Two sets of gears 52, 54 are provided for pivotally connecting the collector 12 to the debris apparatus 10. An operating handle 60 has a U-shape with two legs 62, 64 having teeth 66, 68 thereon for engaging the two sets of gears 52, 54. By moving the handle 60 down approximately eight inches, the teeth 66, 68 on legs 62, 64 operate to turn gears 52, 54. This causes the collector 12 to pivot between a first position for receiving and collecting the debris, and a second position for transferring the debris in the collector 12 to the waste bin 30. When the waste bin 30 is full, the waste bin 30 can then slide out of the apparatus 10 between the first position for collecting the debris to the second position for removing the waste bin 30 from collector 12 to empty the waste bin 30.

Figure 6A:
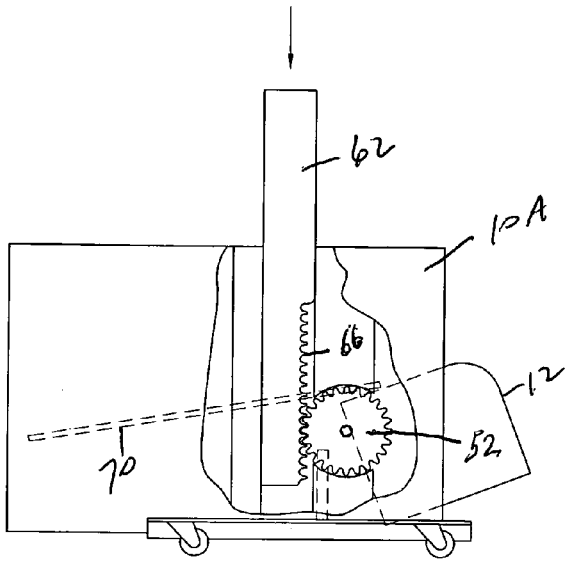
FIGS. 6*a*, 6*b*, and 6*c* show the sequence of operation of lifting collector 12 to transfer the debris into waste bin 30.
Figure 6B:
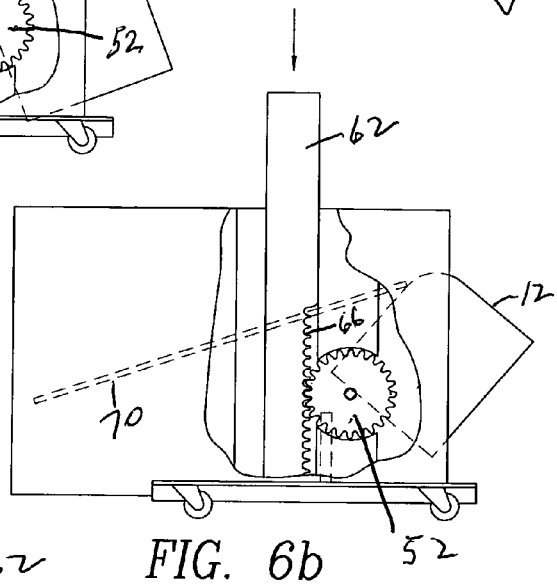
Figure 6C:
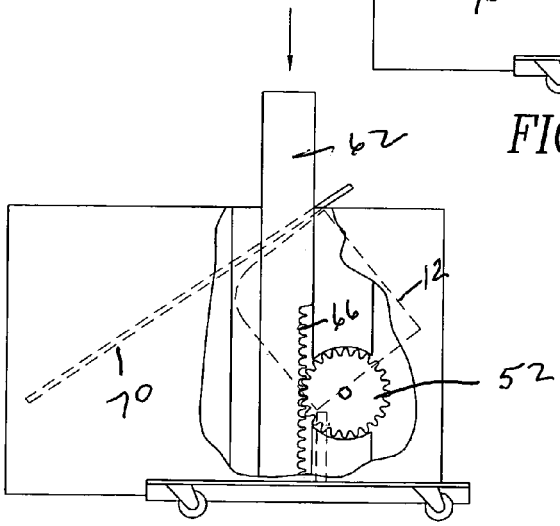
Figure 7:
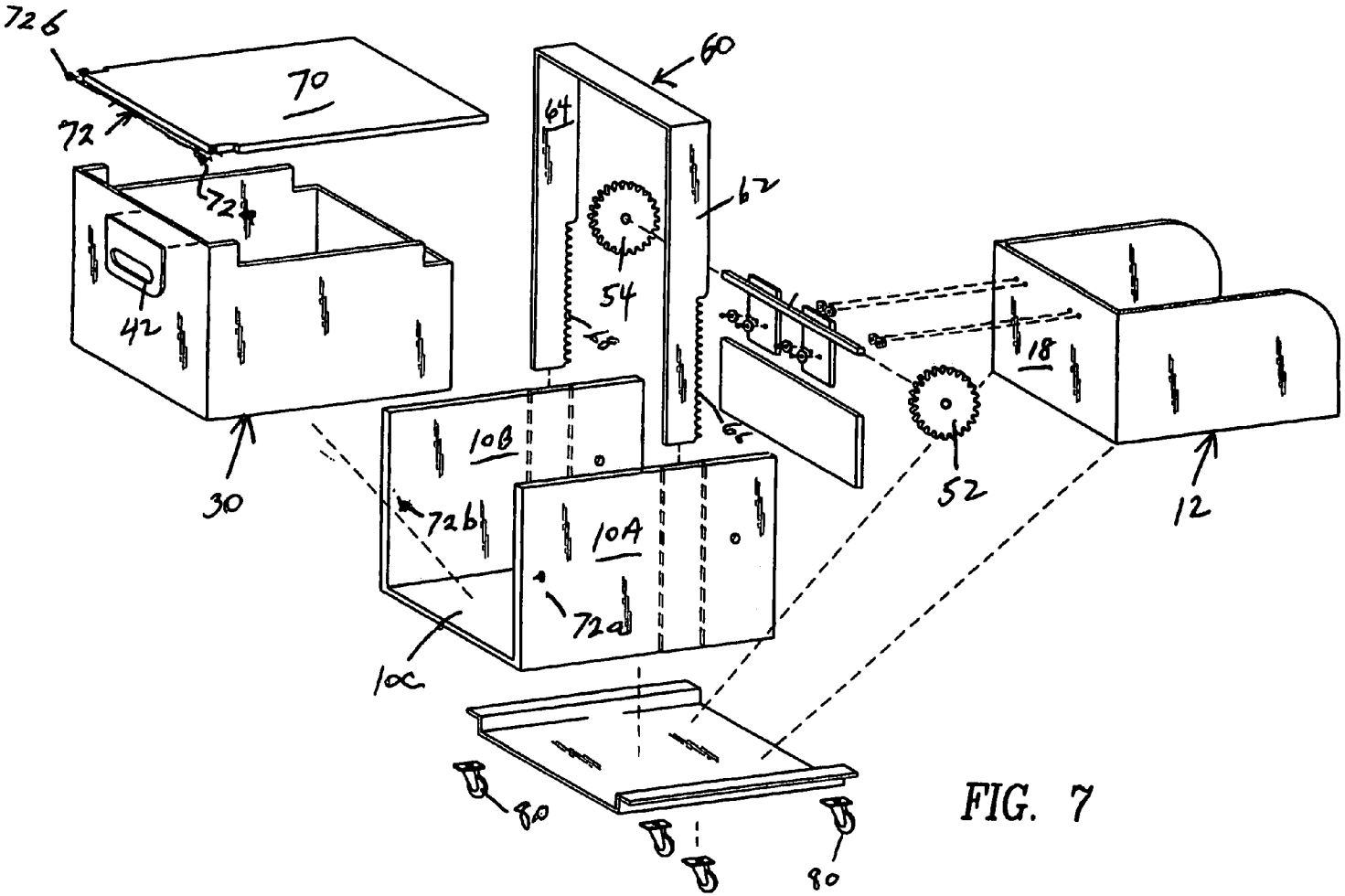
FIG. 7 shows an exploded view of the parts.
Figure 8:
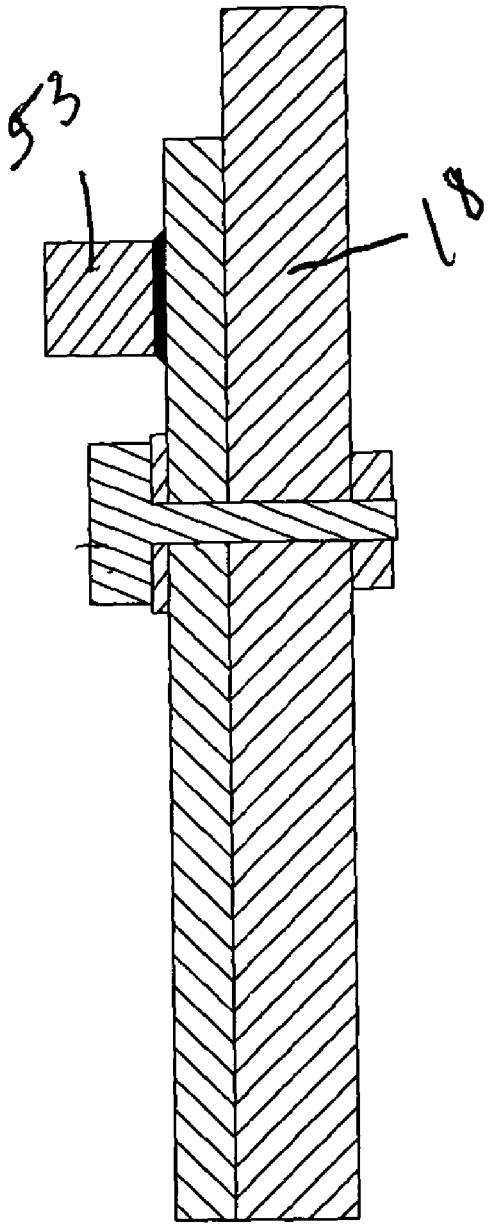
FIG. 8 is a cross-section view taken along lines 8-8 in FIG. 1.

The apparatus 10 includes a movable lid 70 connected to the collector 12. Movement of the collector 12 between the first position for collecting debris and the second position for transferring debris to the waste bin 30, actuates the lid 70 to move upwardly and out of the way of the collector 12 while it moves to the second position to transfer the debris to the waste bin 30. Lid 70 pivots about pivot pin 72, which is mounted on wall 10A at 72*a*, and is mounted on wall 10B at 72*b*, to move lid 70 between the two positions, wherein the lid 70 starts at its first position covering waste bin 30, and then rotates upwardly to its final position, as shown in FIG. 6*c*, to allow the transfer of the debris.

The apparatus 10 includes a set of wheels 80 mounted on the apparatus 10 for moving the apparatus 10 between multiple locations.

The dimensions of the apparatus 10 are as follows. However, it should be understood that these dimensions are by way of example only, and they can be changed to accommodate the particular use. The collector 12 is preferably about 1 foot high, 2 feet wide, and 1 foot in depth. In addition, the waste bin 30 is preferably about 1 foot high, 2 feet wide, and 2 feet in depth. The handle 60 has a height of about 3.5 feet, and the side walls 10A and 10B of the apparatus are about 2.5 feet high and 3 feet wide.

OPERATION OF THE PRESENT INVENTION

Apparatus 10 is moved to a desired location where it is positioned to collect debris. Debris is swept into collector 12, or is placed in collector 12. Then, handle 60 is pushed down to turn gears 52, 54, which causes collector 12 to pivot upwardly to transfer the debris into the waste bin 30 behind collector 12. When the waste bin 30 is full, it slides out of the apparatus and may be emptied.

ADVANTAGES OF THE PRESENT INVENTION

An advantage of the invention is that it is simple to use, inexpensive and may be easily mass produced.

Another advantage of the present invention is that it provides a simple gear mechanism to lift and pivot the collector 12 to transfer debris into the waste bin 30, and the waste bin 30 is easily removable to empty the debris.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A debris apparatus for receiving and collecting debris, comprising:

a collector for receiving and collecting debris in said collector mounted in the front of said debris apparatus;

a waste bin for receiving and holding debris collected by said collector mounted in the rear of said debris apparatus;

gears for pivotally connecting said collector to said debris apparatus;

a manually operating handle which moves up and down to turn said gears to pivot said collector upwardly between a first position for receiving and collecting the debris and a second position for transferring the debris in the collector to said waste bin;

said waste bin being slidably connected to said apparatus to slide between a first position for collecting the debris and a second position for removing said waste bin from said apparatus to empty said waste bin; and a movable lid to cover said waste bin being pivotally connected to said waste bin and slidably connected to the collector and actuated to move by movement of said collector between a first position for collecting debris and a second position for transferring debris to said waste bin.

2. A debris apparatus in accordance with claim 1, wherein said collector has a bottom wall and three side walls which form a U-shape configuration having a first opening for receiving debris swept into said front opening to collect and transfer debris to said waste bin.

3. A debris apparatus in accordance with claim 1, wherein said waste bin includes four side walls for receiving and holding debris collected by said collector.

4. A debris apparatus in accordance with claim 1, wherein said gears are mounted on both sides of said collector to form two sets of rotating gears.

5. A debris apparatus in accordance with claim 4, wherein said operating handle is in the shape of a U having two side legs and a top handle, and wherein each of said side legs includes teeth for engaging said gears in order to move said gears up and down to pivot said collector between said first position and said second position.

6. A debris apparatus in accordance with claim 1, further including a set of wheels mounted on said apparatus for moving said apparatus between multiple locations.

* * * * *